US006786148B2

(12) United States Patent
Friedrichs et al.

(10) Patent No.: US 6,786,148 B2
(45) Date of Patent: Sep. 7, 2004

(54) SHEET-PROCESSING ROTARY PRINTING PRESS WITH A DIE CUTTING OR PUNCHING UNIT, AND METHOD OF OPERATION

(75) Inventors: Jens Friedrichs, Neckargemünd (DE); Jens Hieronymus, Darmstadt (DE); Ralf Wadlinger, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/378,242

(22) Filed: Mar. 3, 2003

(65) Prior Publication Data

US 2004/0011226 A1 Jan. 22, 2004

Related U.S. Application Data

(60) Provisional application No. 60/369,828, filed on Apr. 4, 2002, now abandoned.

(30) Foreign Application Priority Data

Mar. 27, 2002 (DE) ..... 102 13 707

(51) Int. Cl.[7] ..... B41F 7/02

(52) U.S. Cl. ..... 101/217; 101/137; 101/145; 101/247

(58) Field of Search ..... 101/217, 216, 101/137, 142–145, 247, 248

(56) References Cited

U.S. PATENT DOCUMENTS 4,171,081 A 10/1979 Vossen et al. ..... 225/97
4,915,025 A * 4/1990 Miyazaki ..... 101/424.1
5,333,545 A 8/1994 Ganter et al. ..... 101/76
5,443,437 A 8/1995 Mack ..... 493/359
5,540,148 A * 7/1996 Oumiya et al. ..... 101/212
6,027,270 A 2/2000 Greive ..... 400/625

FOREIGN PATENT DOCUMENTS

DE 26 30 094 C2 1/1978
DE 41 36 792 C2 5/1993
DE 41 38 278 C2 5/1993
DE 42 18 422 A1 12/1993
DE 195 16 023 A1 11/1996
DE 197 57 163 A1 6/1999
DE 198 49 633 A1 5/2000

* cited by examiner

*Primary Examiner*—Minh Chau
(74) *Attorney, Agent, or Firm*—Laurence A. Greenberg; Werner H. Stemer; Ralph E. Locher

(57) ABSTRACT

A method of operating a sheet-processing rotary printing press provided with a die cutting or punching unit and a delivery for forming processed sheets into a sheet pile or stack includes, in a first method step, moving the punching or die cutting unit, during production printing by the rotary printing press, from a first operating state of the unit wherein the sheets are punched or die cut, into a second operating state of the unit wherein the sheets are not punched or die cut as they pass the punching or die cutting unit, and after a given number of non-punched or non-die cut sheets have passed through the unit. In a second method step, the punching or die cutting unit is moved back into the first operating state thereof. The invention also includes a method of operating the printing press.

4 Claims, 1 Drawing Sheet

SHEET-PROCESSING ROTARY PRINTING PRESS WITH A DIE CUTTING OR PUNCHING UNIT, AND METHOD OF OPERATION

CROSS-REFERENCE TO RELATED APPLICATION

This application claims the benefit under 35 U.S.C. § 119(e) of provisional application No. 60/369,828, filed Apr. 4, 2002 now abandoned.

BACKGROUND OF THE INVENTION

FIELD OF THE INVENTION

The invention is related to a sheet-processing rotary printing press with a die cutting or punching unit and a delivery for forming processed sheets into a sheet pile or stack. Such a printing press has become known heretofore, for example, from German Patent 41 38 278, and forms sheet piles or stacks which, due to the fact that the piles or stacks being formed are of punched or die cut sheets, require careful handling in order to avoid damaging the sheets.

Thus, it is suggested particularly that sample sheets be selected and sheet pile or stack changes be performed when the printing press is stopped. In this regard, although a sample sheet may indeed be lifted off the sheet pile carefully in this way, there is a risk that this sample sheet is not representative of a given number of further sheets printed after the machine is restarted. On the other hand, in the case of a sheet pile or stack newly formed after interruption of a print run, there is a potential risk that the sheets thereof do not have the required print quality right from the beginning and that this situation will be repeated for every new pile or stack during a large print order.

SUMMARY OF THE INVENTION

It is accordingly an object of the invention, therefore, to provide a sheet processing rotary printing press with a die cutting or punching unit, and a method of operation, wherein the printing quality of a print order processed by the rotary printing press is kept constant.

With the foregoing and other objects in view, there is provided, in accordance with one aspect of the invention, a method of operating a sheet-processing rotary printing press provided with a die cutting or punching unit and a delivery for forming processed sheets into a sheet pile or stack, which comprises, in a first method step, moving the punching or die cutting unit, during production printing by the rotary printing press, from a first operating state of the unit wherein the sheets are punched or die cut, into a second operating state of the unit wherein the sheets are not punched or die cut as they pass the punching or die cutting unit and, after a given number of non-punched or non-die cut sheets have passed through the unit, and in a second method step, moving the punching or die cutting unit back into the first operating state thereof.

In accordance with another mode, the method of the invention further comprises, above the sheet pile or stack, underpinning at an edge thereof a sheet that has not been punched or die cut as the sheet passes through the punching or die cutting unit after the first method step.

In accordance with a further mode, the method of the invention further comprises, in a third method step, again moving the punching or die cutting unit, after the second method step and after at least one further sheet has passed through the punching or die cutting unit, into the second operating state thereof for a time permitting a given number of sheets to pass therethrough and, in a subsequent fourth method step, moving the punching or die cutting unit back into the first operating state thereof.

In accordance with an added mode, the method further comprises, above the sheet pile or stack, underpinning the edge of a sheet that is punched or die cut as it passes through the punching or die cutting unit immediately after the fourth method step.

In accordance with another aspect of the invention, there is provided a sheet-processing rotary printing press, comprising a punching or die cutting unit operatable in a first operating state wherein sheets are punched or die cut as they pass therethrough, and in a second operating state wherein sheets are not punched or die cut as they pass therethrough; a delivery for forming the processed sheets into a sheet pile or stack; a first sheet interceptor introducible into a first interception position above the sheet pile or stack and withdrawable from the first interception position; and a second sheet interceptor introducible into a second interception position above the sheet pile or stack and withdrawable from the second interception position, the second interceptor assuming a level at the second interception position thereof which differs from a level assumed by the first sheet interceptor at the first interception position thereof.

In order to achieve the foregoing object of the invention, the rotary printing press described in the introduction hereto is thus operated in a manner that, in a first method step, the punching or die cutting unit is moved, during production or continuous printing by the rotary printing press, from a first operating state wherein the sheets are punched or die cut, into a second operating state wherein the sheets are not punched or die cut as they pass through the punching or die cutting unit, and, after a given number of non-punched or non-die cut sheets have passed therethrough, the punching or die cutting unit is moved back into the first operating state in a second method step.

In this regard, after the first method step, a non-punched or non-die cut sheet is fed in any case to a sheet pile or stack formed by the delivery, a leading edge of the sheet, for example, being interceptable in a conventional manner by a sheet interceptor, so that a pocket forms between this sheet and the sheet pile or stack, into which an auxiliary pile or stack base can be inserted for a non-stop pile or stack change. In this regard, the auxiliary pile or stack base slides along the underside of the non-punched or non-die cut sheet while punched or die cut sheets are further fed to the pile or stack, as a consequence of the second method step and the deposition of these punched or die cut sheets on the non-punched or non-die cut sheet, and damage to punched or die cut sheets is thereby avoided. To this extent, the operation according to the invention of the rotary printing press mentioned in the introduction hereto makes pile or stack changes possible during production or continuous printing without damaging the sheets, and dispensing with printing interruptions, possible on account thereof, avoids the occurrence of differences in the quality of the printed sheets of a print order even if the printing run is large.

A non-punched or non-die cut sheet deposited on the pile or stack after the first method step has been carried out can also be removed from the pile or stack as a sample sheet without damage to punched or die cut sheets if, for example, the intention is merely to check the print quality achieved by the printing press.

In a preferred development of the method according to the invention, the punching or die cutting unit, after the second method step and after at least one further sheet has passed through the punching unit, is again moved, in a third method step, into the second operating state thereof for the time it takes a given number of sheets to pass through the unit, and is moved back into the first operating state thereof in a subsequent fourth method step.

After the aforedescribed four method steps have been carried out, at least one punched or die cut sheet among the punched or die cut sheets lies at the pile or stack top side between at least one non-punched or non-die cut sheet, respectively, and this ensures that the at least one punched sheet situated between at least one non-punched or non-die cut sheet, respectively, can be drawn off from the pile or stack in the manner of a sample sheet removal jointly with these enclosing non-punched or non-die cut sheets, without damaging punched or die cut sheets.

Such removable punched or die cut and non-punched or non-die cut sample sheets permit not only the print quality to be checked but also the functioning of the punching or die cutting unit, in particular with regard to a possibly necessary correction to the punching or die cutting pressure of the punching or die cutting tools.

An advantageous preparatory step to the actual removal of the aforementioned sample sheets preferably lies in providing a sheet which is not punched or die cut as it passes through the punching or die cutting unit after the first method step and a sheet which is punched or die cut as it passes through the punching or die cutting unit immediately after the fourth method step being underpinned above the pile or stack, respectively, preferably at the leading edge of the sheets. In this way, a type of sandwich comprising at least one punched or die cut sheet lying between at least one non-punched or non-die cast sheet, respectively, is exposed in a region of mutually coordinated edges of these sheets. This sandwich can then be grasped without difficulty and removed from the pile or stack, only non-punched or non-die cut sheets being always drawn along punched or die cut sheets with the result that the latter remain undamaged.

Other features which are considered as characteristic for the invention are set forth in the appended claims.

Although the invention is illustrated and described herein as embodied in a sheet-processing rotary printing press with a die cutting or punching unit, and a method of operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing.

DESCRIPTION OF THE PREFERRED EMBODIMENT

Figure 1:
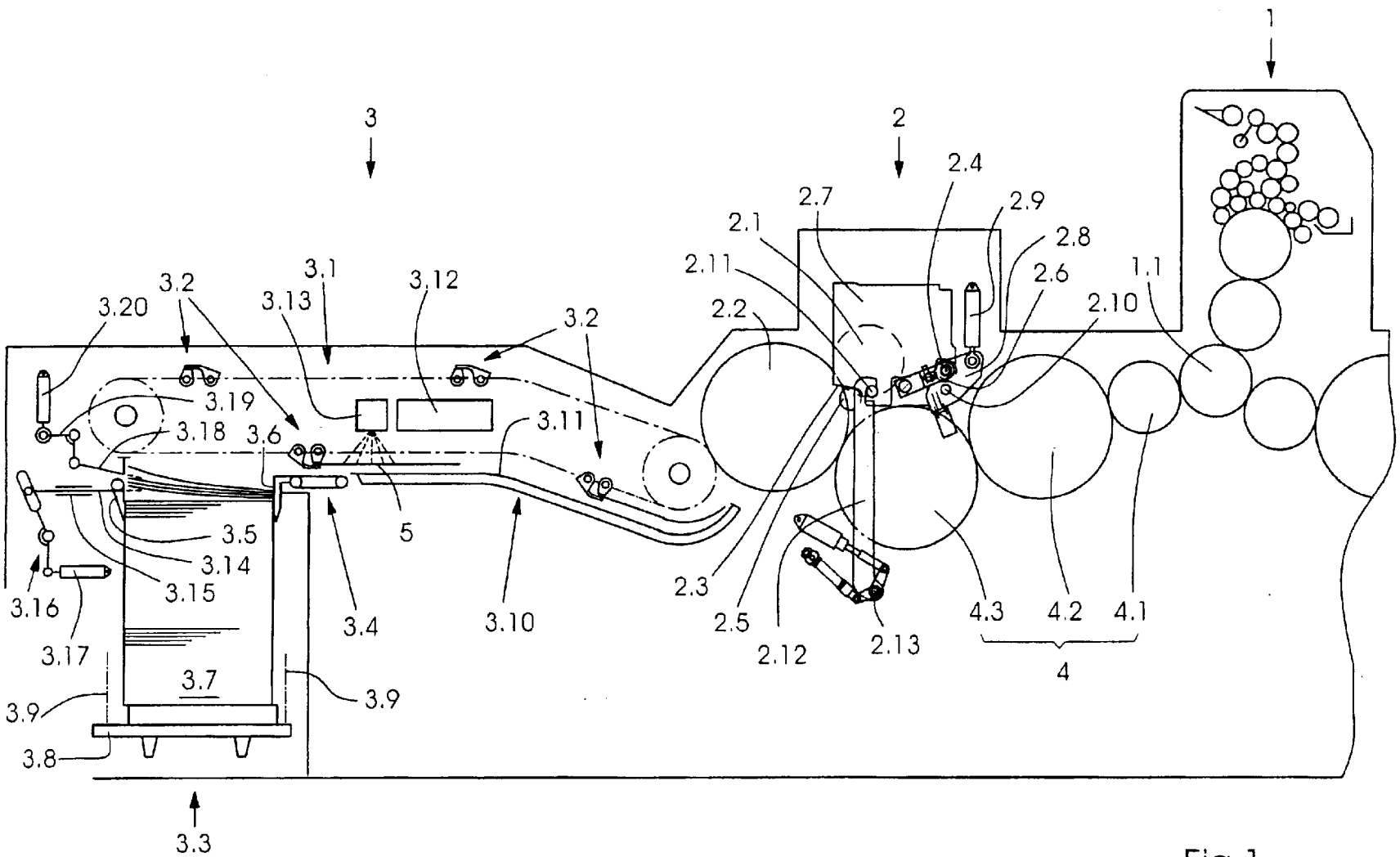
FIG. 1 is a fragmentary diagrammatic side elevational view of the sheet-processing rotary printing press according to the invention.

Referring now to FIG. 1, the only FIGURE of the drawing, there is shown therein the sheet-processing rotary printing press according to the invention, which is suitable for performing the method of the invention. In the illustrated fragmentary view of the sheet-processing rotary printing press according to the invention, there is included a processing station in the form of a printing unit 1, a processing station in the form of a die cutting or punching unit 2 located downstream therefrom, as viewed in sheet travel direction from the righthand to the lefthand side of the figure, and a delivery 3 located farther downstream. The printing unit 1 shown here by way of example operates according to the wet offset process and is the last in a series of printing units, the number of which depends upon the number of colors to be printed. The printing unit 1 includes, in particular, an impression cylinder 1.1 engaged by a succession of transfer drums 4.1, 4.2 and 4.3 of a sheet transfer device 4, which feeds printed sheets 5 to a die cutting or punching cylinder 2.2 cooperating with a die cutting or punching form cylinder 2.1 of the die cutting or punching unit 2, which is discussed hereinafter in greater detail. The die cutting or punching cylinder 2.2 then transfers the sheets 5, whether die cut or punched, or, if required, not die cut or punched, to the delivery 3.

In the embodiment shown by way of example, the delivery 3 comprises a chain conveyor 3.1 having gripper systems 3.2 articulated thereon, which revolve during operating, receive or take over the sheets 5 from the die cutting or punching cylinder 2.2 when passing the latter, transport the sheets 5 along a transport path traversed by a lower strand of the chain conveyor 3.1 in a direction towards a pile forming or stacking station 3.3 and transfer the sheets 5 to a sheet brake 3.4, by which the sheets 5 are finally transferred to the pile forming or stacking station 3.3, after they have been braked from the processing speed to a depositing speed.

During normal operation of the printing press, the sheets 5 released by the sheet brake 3.4 strike leading edge stops 3.5 in the pile forming or stacking station 3.3 and, while being aligned with the leading edge stops, opposite trailing edge stops 3.6 and also non-illustrated lateral joggers, forming a pile or stack 3.7 which is lowerable by a hoisting unit to an extent at which the pile, also referred to as a stack 3.7, grows. A platform 3.8 carrying the pile 3.7 and hoist chains 3.9 carrying the platform 3.8 are all that is shown of the hoisting unit here.

A guide device 3.10 is provided along the transport path and is formed with a guide surface 3.11 over which the processed sheets 5 are drawn by the gripper systems 3.2. For floatingly guiding, over the guide surface 3.11, sheets processed by recto and verso printing, when the printing press is correspondingly equipped with a sufficient number of printing units and a sheet reversing station, the guide surface 3.11 is provided with non-illustrated air outlet openings from which sheet supporting air flows out during operation for forming an air cushion between the guide surface 3.11 and the sheets 5 which are being drawn over the guide surface 3.11.

The hereinaforementioned transport path furthermore has aftertreatment devices assigned thereto in the form of a dryer device 3.12 (for example, a hot air, IR, UV dryer) and a powder spraying device 3.13. The guide device 3.10 is cooled in a conventional otherwise non-illustrated manner in order to avoid excessive heating thereof by the dryer device 3.12, and is configured for this purpose as a cooling trough through which cooling liquid flows.

The lowering of the sheet pile or stack 3.7 to the same extent as the growth thereof, as mentioned hereinbefore, results in a respective one of the sheets 5 released by the sheet brake 3.4 being deposited at least approximately at one and the same level (the so-called "production level") onto the pile or stack 3.7.

Functionally assigned to this production level is a first sheet interceptor 3.14 which is introducible into an interception position above the pile or stack 3.7 and withdrawable from the interception position, and which is displaceable between the interception position represented by a broken line and the withdrawn position represented by a solid line by a suitable lever arrangement 3.16 and an articulatedly supported actuating cylinder 3.17 acting thereon, the first sheet interceptor 3.14 being disposed in the withdrawn position outside the region wherein the sheets 5, having been released by the sheet brake 3.4, fall onto the pile or stack 3.7.

The first sheet interceptor 3.14 catches underneath or underpins a leading edge of a falling sheet 5 in the interception position. The first sheet interceptor 3.14 is moved into this interception position when, in the course of an intended removal of a sample sheet, a first sheet 5 that has not been punched or die cut falls onto the pile or stack 3.7 after the first method step followed by at least one punched or die cut sheet 5 after the second method step.

A second sheet interceptor 3.18, which can in turn be moved between an interception position above the pile or stack 3.7 and a position withdrawn from the interception position, is arranged at a level which differs from, i.e., in this case is higher than, the level of the first sheet interceptor 3.14, the second sheet interceptor being in turn represented by a broken line in the interception position thereof and by a solid line in the position thereof withdrawn from the interception position. In order to activate the second sheet interceptor 3.18 in an appropriate manner, it is supported on a shaft bearing the leading edge stops 3.5 in the exemplary embodiment at hand and is articulatedly connected to a double lever or bellcrank 3.19 which is adjustable by an actuating cylinder 3.20.

In the case of sample sheet removal assumed here, the second sheet interceptor 3.18 is moved into the interception position thereof located above the interception position of the first sheet interceptor 3.14 after the first sheet interceptor 3.14 has been moved into the interception position thereof and has caught underneath or underpinned the edge of at least one sheet 5 that has not been punched or die cut, due to a preceding temporary changeover of the die cutting or punching unit 2 to the non-die cutting or nonpunching operating state thereof, after furthermore at least one die cut or punched sheet 5 has been deposited on the sheet 5 that has not been die cut or punched due to a further temporary changeover of the die cutting or punching unit 2 to the die cutting or punching operating state thereof and after at least one sheet 5 that has not been punched or die cut has been deposited on the at least one punched or die cut sheet 5 as a result of a repeated temporary changeover of the punching or die cutting unit 5 to the non-punching or non-die cutting operating state thereof, and before punched or die cut sheets 5 once again follow the deposited non-punched or non-die cut sheet 5 as a result of a renewed changeover of the punching or die cutting unit 2 to the punching or die cutting operating state thereof.

The two sheet interceptors 3.14 and 3.18 then enclose the aforementioned sandwich wherein at least one punched sheet 5 is located between at least, respectively, one non-punched or non-die cut sheet 5.

Once this sandwich has been removed, the two sheet interceptors 3.14 and 3.18 are again withdrawn from the interception positions thereof.

It is believed to be readily apparent that the respective timing of the movement of these sheet interceptors 3.14 and 3.18 into the respective interception position thereof is coordinated with the timing of respective operating state changes of the punching or die cutting unit 2 and with the time it takes the sheets 5 to be transported between the punching or die cutting unit 2 and the stacking station 3.3.

In order to effect a pile or stack change during non-stop operation, only one of the two sheet interceptors 3.14 or 3.18 is required. In this case, the punching or die cutting unit 2 is temporarily moved from the punching or die cutting operating state thereof to the non-punching or non-die cutting operating state thereof, and one of the sheet interceptors 3.14 or 3.18 is not moved into the interception position thereof until a first non-punched or non-die cut sheet 5 reaches the stacking station 3.3.

In the preceding representations, a punching or die cutting unit 2 which is convertible or switchable, during production printing by the rotary printing press, between a punching or die cutting and a non-punching or non-die cutting operating state has been assumed. Recourse is preferably made to the teachings which can be gathered from the published German Non-prosecuted Patent Application DE 198 49 633 A1 in order to realize the punching or die cutting unit. In particular, the punching or die cutting form cylinder 2.1 is mounted in side parts 2.7 supported on rollers 2.5 and 2.6 at supporting surfaces 2.3 and 2.4, the rollers 2.5 being mounted in a locally fixed position and the rollers 2.6 being mounted in pivoting parts 2.8, which are pivotable about a locally fixed or stationary shaft 2.10 by actuating drives 2.9.

In the sole FIGURE of the drawing, the punching or die cutting form cylinder 2.1 is set against the punching or die cutting cylinder 2.2, i.e., the punching or die cutting unit 2 is in the operationally punching or die cutting operating state thereof. By pivoting the pivoting part 2.8 out of the illustrated position in a clockwise direction, the punching or die cutting form cylinder 2.1 moves away from the punching or die cutting cylinder 2.2 into a position wherein the punching or die cutting form cylinder 2.1 does not make contact with the sheets 5 guided by the punching or die cutting cylinder 2.2.

The supporting surfaces 2.3 and 2.4 held in contact with the rollers 2.5 and 2.6 by tie rods 2.12 acting on pins 2.11 are moreover configured and arranged so that the side parts 2.7 are displaced during activation of the actuating drive 2.9 so that the pins 2.11 execute a circular movement about the respective articulation point 2.13 of the tie rods 2.12 with the result that a locked state of the side parts 2.7 brought about by the tie rods 2.12 is maintained even when the side parts are adjusted by activating the actuating drive 2.9.

The overall result is that the punching or die cutting unit 2 can be switched or converted between a punching or die cutting and a non-punching or non-die cutting operating state and the reverse by the actuating drive 2.9 during production printing by the rotary printing press.

The operating modes of sample sheet removal and stack or pile change during non-stop operation are thus ultimately realizable by respective calibration of the activation or actuation of the actuating drive 2.9 of the punching or die cutting unit and of the actuating cylinders 3.17 and 3.20 assigned to the respective sheet interceptors 3.14 and 3.18.

We claim:

1. A method of operating a sheet-processing rotary printing press provided with a die cutting or punching unit and a delivery for forming processed sheets into a sheet pile, which comprises:

in a first method step, moving the punching or die cutting unit, during production printing by the rotary printing press, from a first operating state of the unit wherein the sheets are punched or die cut, into a second operating state of the unit wherein the sheets are not punched or die cut as the sheets pass the punching or die cutting unit and, after a given number of non-punched or non-die cut sheets have passed through the unit;

in a second method step, moving the punching or die cutting unit back into the first operating state thereof.

2. The method according to claim 1, which further comprises, above the sheet pile, underpinning at an edge thereof a sheet that has not been punched or die cut as the sheet passes through the punching or die cutting unit after the first method step.

3. The method according to claim 1, which further comprises:

in a third method step, again moving the punching or die cutting unit, after the second method step and after at least one further sheet has passed through the punching or die cutting unit, into the second operating state thereof for a time permitting a given number of sheets to pass therethrough; and, in a subsequent fourth method step, moving the punching or die cutting unit back into the first operating state thereof.

4. The method according to claim 3, which further comprises, above the sheet pile or stack, underpinning the edge of a sheet that is punched or die cut as it passes through the punching or die cutting unit immediately after the fourth method step.

* * * * *